US011050152B2

(12) United States Patent
Smith

(10) Patent No.: US 11,050,152 B2
(45) Date of Patent: Jun. 29, 2021

(54) AESA COMPOUND CURRED DOME PHASED ARRAY ANTENNA

(71) Applicant: AVX Corporation, Fountain Inn, SC (US)

(72) Inventor: David M. Smith, Sebastian, FL (US)

(73) Assignee: AVX Corporation, Fountain Inn, SC (US)

( * ) Notice: Subject to any disclaimer, the term of this patent is extended or adjusted under 35 U.S.C. 154(b) by 60 days.

(21) Appl. No.: 16/268,549

(22) Filed: Feb. 6, 2019

(65) Prior Publication Data

US 2019/0252782 A1 Aug. 15, 2019

Related U.S. Application Data

(60) Provisional application No. 62/628,572, filed on Feb. 9, 2018.

(51) Int. Cl.

| | |
|---|---|
| ***H01Q 9/04*** | (2006.01) |
| ***H01Q 21/06*** | (2006.01) |
| ***H01Q 13/18*** | (2006.01) |
| ***H01Q 3/30*** | (2006.01) |

(52) U.S. Cl.

CPC ..... *H01Q 9/0407* (2013.01); *H01Q 13/18* (2013.01); *H01Q 21/065* (2013.01); *H01Q 3/30* (2013.01)

(58) Field of Classification Search

CPC .... H01Q 1/273; H01Q 1/2216; H01Q 9/0407; H01Q 9/0457; H01Q 1/38; H01Q 1/42; H01Q 11/10; H01Q 1/12; H01Q 1/3275; H01Q 1/3291; H01Q 3/02; H01Q 5/321; H01Q 9/34; H01Q 13/18; H01Q 15/0086; H01Q 15/14; H01Q 15/142; H01Q 15/147; H01Q 15/16; H01Q 19/06; H01Q 19/062; H01Q 19/17; H01Q 1/2258; H01Q 1/2266; H01Q 1/26; H01Q 1/366; H01Q 1/405; H01Q 21/00; H01Q 21/065; H01Q 21/08; H01Q 21/24; H01Q 21/28; H01Q 25/00; H01Q 25/007; H01Q 25/008; H01Q 3/08; H01Q 3/18; H01Q 3/26; H01Q 3/2658; H01Q 3/2664; H01Q 3/30; H01Q 3/44;

(Continued)

(56) References Cited

U.S. PATENT DOCUMENTS

| | | | |
|---|---|---|---|
| 3,845,389 | A | 10/1974 | Phillips et al. |
| 4,284,991 | A | 8/1981 | Dupressoir |
| 4,587,524 | A | 5/1986 | Hall |

(Continued)

FOREIGN PATENT DOCUMENTS

| | | |
|---|---|---|
| CN | 106099395 | 11/2016 |
| EP | 3242358 | 11/2017 |

(Continued)

OTHER PUBLICATIONS

International Preliminary Report on Patentability for Application No. PCT/US2019/016775, dated Aug. 20, 2020, 7 pages.

(Continued)

*Primary Examiner* — Monica C King

(74) *Attorney, Agent, or Firm* — Dority & Manning P.A.

(57) ABSTRACT

A phased array antenna is provided. The phased array antenna includes a dome shaped substrate. The phased array antenna further includes a plurality of antenna elements disposed on the substrate.

13 Claims, 4 Drawing Sheets

(58) Field of Classification Search
CPC H01Q 3/46; H01Q 5/307; H01Q 7/00; H01Q 9/16
See application file for complete search history.

(56) References Cited

U.S. PATENT DOCUMENTS

| | | | |
|---|---|---|---|
| 5,220,340 | A | 6/1993 | Shafai |
| 5,430,453 | A | 7/1995 | Rudish et al. |
| 5,886,667 | A | 3/1999 | Bondyopadhayay |
| 6,104,343 | A | 8/2000 | Brookner |
| 6,512,487 | B1 | 1/2003 | Taylor et al. |
| 7,119,745 | B2 | 10/2006 | Gaucher |
| 7,215,284 | B2 | 5/2007 | Collinson |
| 7,598,918 | B2 | 10/2009 | Durham et al. |
| 7,868,830 | B2 | 1/2011 | Worl |
| 9,214,734 | B2 | 12/2015 | Huynh |
| 9,276,315 | B2 | 3/2016 | Noble |
| 10,020,587 | B2 | 7/2018 | Henry et al. |
| 10,476,170 | B2 | 11/2019 | Rajagopalan |
| 2003/0095067 | A1 | 5/2003 | Howell |
| 2004/0174303 | A1 | 9/2004 | Duxbury et al. |
| 2007/0014383 | A1* | 1/2007 | Lam ..... H01Q 3/02 375/316 |
| 2008/0030404 | A1 | 2/2008 | Irwin et al. |
| 2008/0191950 | A1 | 8/2008 | Chang et al. |
| 2010/0066590 | A1 | 3/2010 | Brown et al. |
| 2015/0116184 | A1 | 4/2015 | Curran et al. |
| 2015/0364815 | A1 | 12/2015 | Yong et al. |
| 2016/0209512 | A1 | 7/2016 | Tatarnikov et al. |
| 2016/0294053 | A1 | 10/2016 | Boutayeb |
| 2019/0252782 | A1 | 8/2019 | Smith |
| 2020/0136234 | A1* | 4/2020 | Paulotto ..... H01Q 1/243 |

FOREIGN PATENT DOCUMENTS

| | | |
|---|---|---|
| JP | 2006-134148 | 5/2006 |
| JP | 4384610 | 8/2006 |
| KR | 20040073713 | 8/2004 |
| KR | 10-2004-0073713 | 3/2005 |

OTHER PUBLICATIONS

International Search Report and Written Opinion for PCT/US2019/016775, dated Apr. 29, 2020, 10 pages.

* cited by examiner

AESA COMPOUND CURRED DOME PHASED ARRAY ANTENNA

PRIORITY CLAIM

The present application is based on and claims priority to U.S. Provisional App. No. 62/628,572, titled "Dome-Shaped Scanned Antenna Assembly," having a filing date of Feb. 9, 2018, which is incorporated by reference herein.

FIELD

The present disclosure relates generally to phased array antennas.

BACKGROUND

Phased array antennas can be used for various applications. For example, phased array antennas can be used in radar systems. Example phased array antennas can include a plurality of antenna elements and a plurality of phase shifters. Each antenna element can be in communication with a corresponding phase shifter of the plurality of phase shifters. Furthermore, operation of each phase shifter can be controlled via a computing device. In this manner, the computing device can control operation of the phase shifters to electronically steer a radiation pattern of the phased array antenna without physically moving the plurality of antenna elements.

SUMMARY

Aspects and advantages of embodiments of the present disclosure will be set forth in part in the following description, or may be learned from the description, or may be learned through practice of the embodiments.

In one aspect, a phased array antenna is provided according to example embodiments of the present disclosure. The phased array antenna includes a dome-shaped substrate. The phased array antenna further includes a plurality of antenna elements disposed on the dome-shaped substrate.

In another aspect, a phased array antenna is provided according to example embodiments of the present disclosure. The phased array antenna includes a dome-shaped substrate. The phased array antenna further includes a plurality of antenna elements disposed on an inner surface of the dome-shaped substrate.

In yet another aspect, a phased array antenna is provided according to example embodiments of the present disclosure. The phased array antenna includes a dome-shaped substrate. The phased array antenna further includes a plurality of antenna elements disposed on an outer surface of the dome-shaped substrate.

These and other features, aspects and advantages of various embodiments will become better understood with reference to the following description and appended claims. The accompanying drawings, which are incorporated in and constitute a part of this specification, illustrate embodiments of the present disclosure and, together with the description, serve to explain the related principles.

BRIEF DESCRIPTION OF THE DRAWINGS

These and other features, aspects and advantages of various embodiments will become better understood with reference to the following description and appended claims. The accompanying drawings, which are incorporated in and constitute a part of this specification, illustrate embodiments of the present disclosure and, together with the description, serve to explain the related principles.

DETAILED DESCRIPTION

Figure 1:
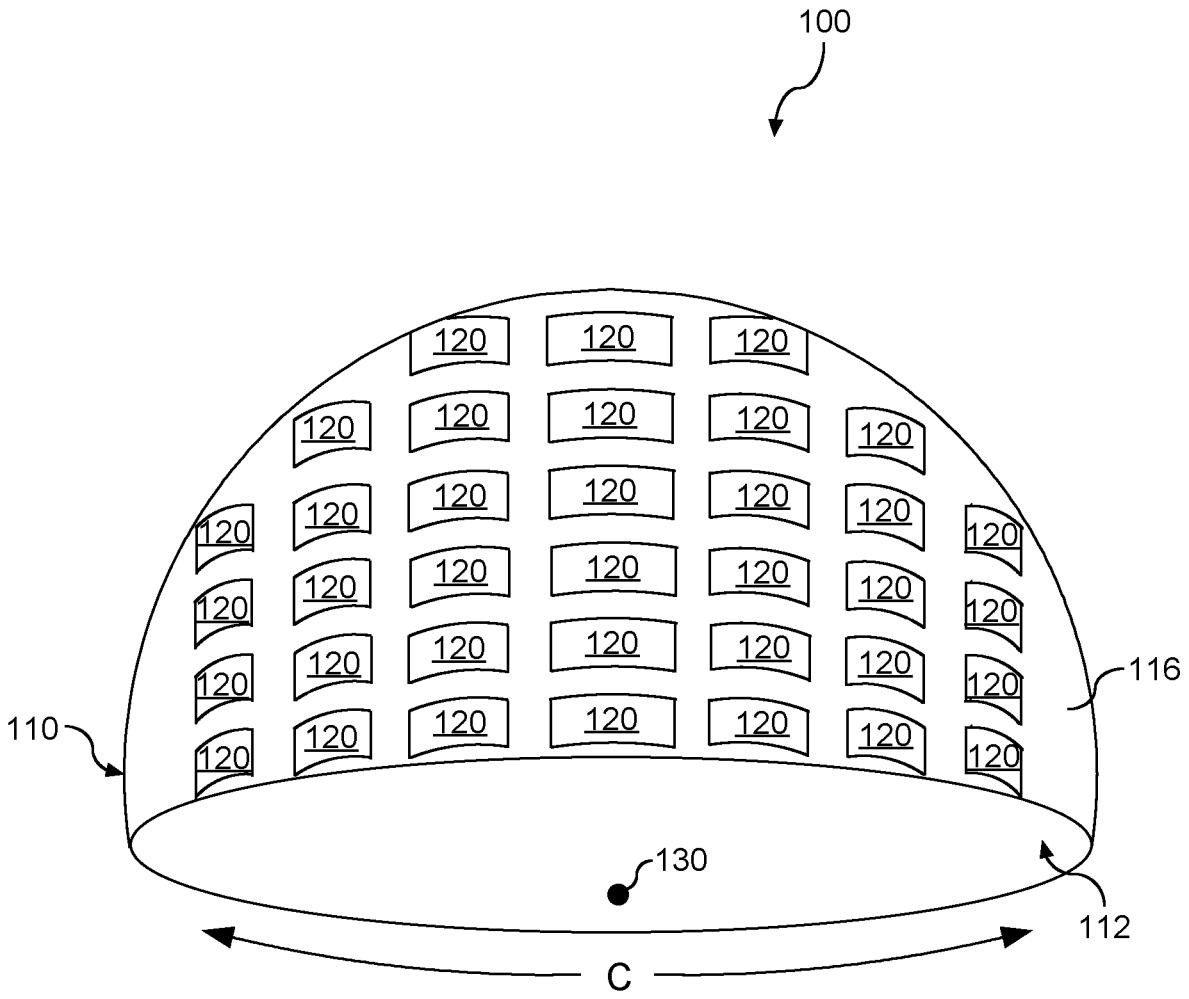
FIG. 1 depicts a phased array antenna according to example embodiments of the present disclosure.

Reference now will be made in detail to embodiments, one or more examples of which are illustrated in the drawings. Each example is provided by way of explanation of the embodiments, not limitation of the present disclosure. In fact, it will be apparent to those skilled in the art that various modifications and variations can be made to the embodiments without departing from the scope or spirit of the present disclosure. For instance, features illustrated or described as part of one embodiment can be used with another embodiment to yield a still further embodiment. Thus, it is intended that aspects of the present disclosure cover such modifications and variations.

Example aspects of the present disclosure are directed to a phased array antenna. The phased antenna array can include a dome-shaped substrate. The phased array antenna can include a plurality of antenna elements. Each antenna element of the plurality of antenna elements can be disposed on the dome-shaped substrate. For instance, in some implementations, the plurality of antenna elements can be disposed on an inner surface of the dome-shaped substrate. In this manner, RF signals transmitted or received via the plurality of antenna elements propagate through the dome-shaped substrate. In alternative implementations, the plurality of antenna elements can be disposed on an outer surface of the dome-shaped substrate. In this manner, RF signals can be transmitted or received via the plurality of antenna elements without propagating through the dome-shaped substrate.

In some implementations, one or more antenna elements of the plurality of antenna elements can be slot antennas. For instance, a first antenna element of the plurality of antenna elements and a second antenna element of the plurality of antenna elements can each define one or more slots. In some implementations, the one or more slots defined by the first antenna element can be different than the one or more slots defined by the second antenna element. For instance, the size of the one or more slots defined by the first antenna element can be different than the size of the one or more slots defined by the second antenna element. Alternatively or additionally, the shape of the one or more slots defined by the first antenna element can be different than the shape of the one or more slots defined by the second antenna element. In this manner, a radiation pattern associated with the first antenna element can be different than a radiation pattern associated with the second antenna element.

In some implementations, one or more antenna elements of the plurality of antenna elements can be a patch antenna. For instance, one or more patch antennas can be disposed on a surface of the dome-shaped substrate. In some implementations, the one or more patch antennas can be disposed on the inner surface of the dome-shaped substrate. Alternatively, the one or more patch antenna can be disposed on the outer surface of the dome-shaped substrate. In some implementations, the patch array antenna can include a first patch antenna and a second patch antenna. The first patch antenna and the second patch antenna can have a first radiation pattern and a second radiation pattern, respectively. In some implementations, the first radiation pattern can be different than the second radiation pattern.

In some implementations, the plurality of antenna elements can each have any suitable shape. For instance, one or more antenna elements of the plurality of antenna elements can have a tetragonal shape, an oval shape, a spiral shape, or a polygonal shape. In some implementations, a shape of an antenna element of the plurality of antenna elements can depend on a location of the antenna element on the dome-shaped substrate.

The phased array antenna of the present disclosure can provide numerous technical benefits. For instance, the dome-shaped substrate allows the plurality of antenna elements to be placed on the substrate in a manner that improves the radiation pattern of the phased array antenna. More specifically, the plurality of antenna elements can be placed on the dome-shaped substrate such that the radiation pattern can be more omnidirectional. In addition, the dome-shaped substrate allows a radiation pattern of each antenna element of the plurality of antenna elements to be steered without the aid of mechanical components (e.g., servo motors).

It should be appreciated that the phased array antenna of the present disclosure can be used for any suitable purpose. For instance, in some implementations, the phased array antenna can be used in radar systems. In alternative implementations, the phased array antenna can be used in telecommunications systems.

As used herein, the use of the term "about" in conjunction with a numerical value is intended to refer to within 20% of the stated amount. In addition, the terms "first," "second," and "third" may be used interchangeably to distinguish one component from another and are not intended to signify location or importance of the individual components.

Referring now to FIG. 1, a phased array antenna 100 is provided according to example embodiments of the present disclosure. As shown, the phased array antenna 100 can define a coordinate system that includes a circumferential direction C and a radial direction R. The phased array antenna 100 can include a dome-shaped substrate 110. The dome-shaped substrate 110 can define a cavity 112. In some implementations, the cavity 112 can be filled with any suitable dielectric material. In alternative implementations, the cavity 112 can be hollow (e.g., filled with air).

It should be appreciated that the dome-shaped substrate 110 can be formed from ceramic, alumina, sapphire, gallium arsenide, polytetrafluoroethylene (e.g., Teflon) or any outer suitable material. It should also be appreciated that the dome-shaped substrate 110 can be formed from material have any suitable dielectric constant. For instance, in some implementations, the dome-shaped substrate 110 can be formed from material having a dielectric constant between about 2 and about 10. As will be discussed below in more detail, the phased array antenna 100 can include a plurality of antenna elements 120 disposed on the dome-shaped substrate 110.

Figure 2:
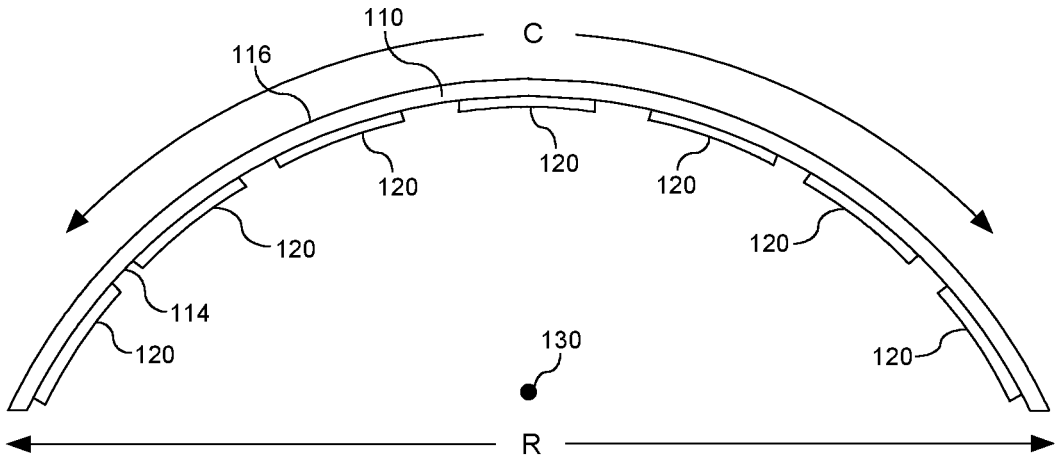
FIG. 2 depicts a cross-sectional view of a phased array antenna according to example embodiments of the present disclosure.

Referring briefly now to FIG. 2, the plurality of antenna elements 120 can be disposed on an inner surface 114 of the dome-shaped substrate 110 (that is, the surface facing towards a center or central axis 130 of the dome-shaped substrate 110). When the plurality of antenna elements 120 are disposed on the inner surface 114 of the dome-shaped substrate 110, the plurality of antenna elements 120 can be disposed within the cavity 112 defined by the dome-shaped substrate 110. In this manner, the plurality of antenna elements 120 can, at least in part, be hidden from view. As shown, each antenna element of the plurality of antenna elements 120 may be curved to conform to a shape (e.g., dome) of the dome-shaped substrate 110. In this manner, the plurality of antenna elements 120 can be disposed on the inner surface 114 of the dome-shaped substrate 110. It should be appreciated that RF signals transmitted or received via the plurality of antenna elements 120 can propagate through the dome-shaped substrate 110 when the plurality of antenna elements 120 are disposed on the inner surface 114 of the substrate 110.

Figure 3:
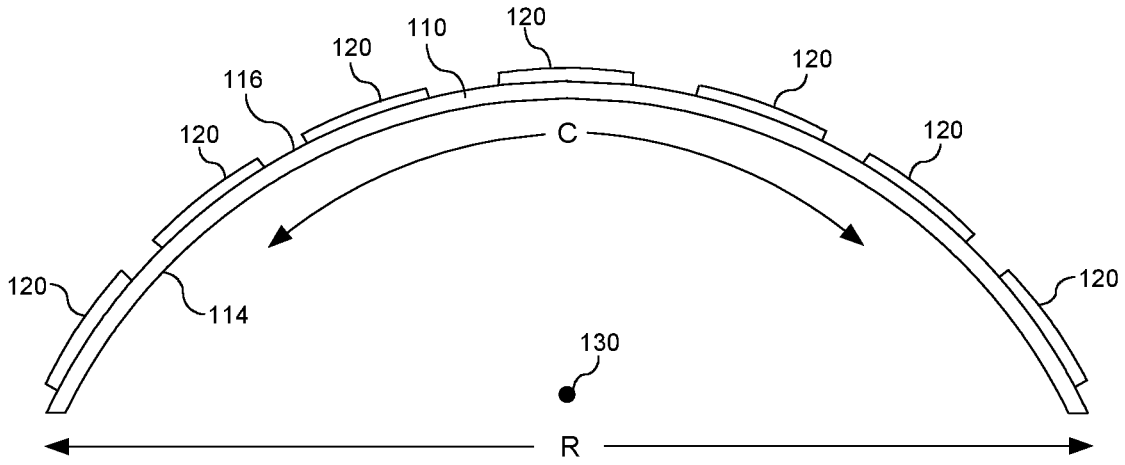
FIG. 3 depicts a cross-sectional view of a phased array antenna according to example embodiments of the present disclosure.

Referring now to FIG. 3, the plurality of antenna elements 120 can be disposed on an outer surface 116 of the dome-shaped substrate 110 (that is, the surface facing away from the center 130 of the substrate 110). When the plurality of antenna elements 120 are disposed on the outer surface 116 of the dome-shaped substrate 110, the plurality of antenna elements 120 are not disposed within the cavity 112 defined by the dome-shaped substrate 110. In this manner, the plurality of antenna elements 120 can be visible. As shown, each antenna element of the plurality of antenna elements 120 can be curved to conform to a shape (e.g., dome) of the dome-shaped substrate 110. In this manner, the plurality of antenna elements 120 can be disposed on the outer surface 116 of the dome-shaped substrate 110. It should be appreciated that RF signals transmitted or received via the plurality of antenna elements 120 do not propagate through the dome-shaped substrate 110 when the plurality of antenna elements 120 are disposed on the outer surface 116 of the dome-shaped substrate 110.

In some implementations, the plurality of antenna elements 120 may be dispersed by a unit distance. For instance, the antenna elements 120 may each be associated with specific corresponding locations on the dome-shaped substrate 110. Different electrical signals received at two or more antenna elements 120 can be combined or compared by drive circuitry (not shown) to accurately identify a direction of an incoming wireless signal. Accordingly, the phase array antenna 100 can operate with high antenna gain in an omnidirectional manner.

In some implementations, each antenna element of the plurality of antenna elements 120 can be tuned to transmit or receive a RF signal with a particular antenna gain in a direction away from the center 130. Beam steering/forming can be selectively determined by altering the phase and/or timing of a signal from the respective antenna element 120. For instance, in some implementations, an antenna element of the plurality of antenna elements 120 may have a higher antenna gain than an adjacent antenna element for a particular direction. However, the adjacent antenna element can have a higher antenna gain than the antenna element in a different direction.

In some implementations, each antenna element of the plurality of antenna elements 120 can be formed from any suitable conductive material (e.g., copper, gold, silver, or combination thereof). Alternatively or additionally, the plurality of antenna elements 120 can each have a same shape, size and/or area. In alternative implementations, each antenna element of the plurality of antenna elements 120 can have a different shape, size and/or area.

Figure 4:
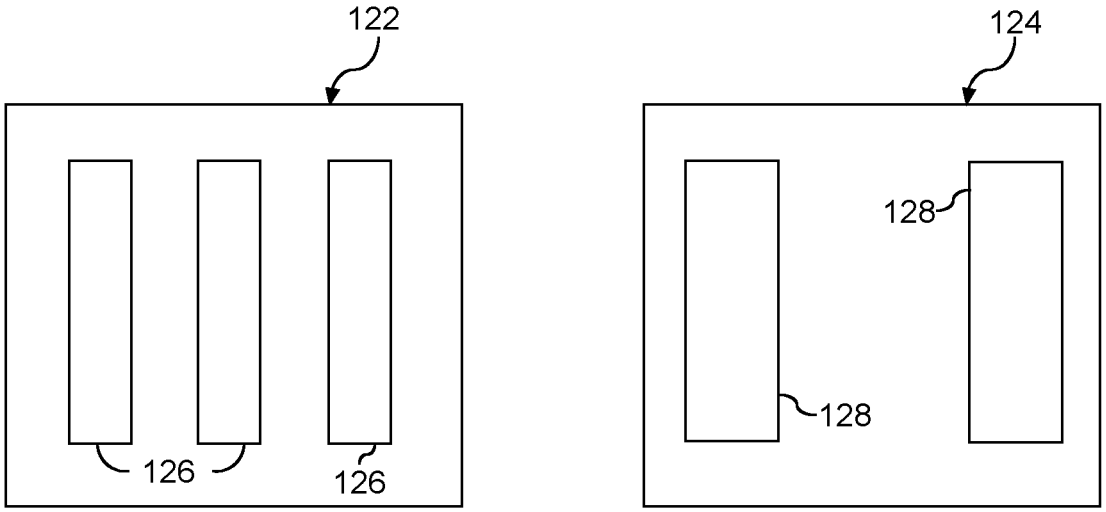
FIG. 4 depicts a first antenna of a phased array antenna and a second antenna of the phased array antenna according to example embodiments of the present disclosure.

Referring now to FIG. 4, a first antenna element 122 of the plurality of antenna elements 120 (FIGS. 1 and 2) and a second antenna element 124 of the plurality of antenna elements 120 can be slot antennas. It should be appreciated that more or fewer antenna elements of the plurality of antenna elements can be patch antennas. For instance, in some implementations, each antenna element of the plurality of antenna elements 120 can be a slot antenna.

As shown, the first antenna element 122 and the second antenna element 124 can each define one or more slots 126 and 128, respectively. In some implementations, the one or more slots 126 defined by the first antenna element 122 can be different than the one or more slots 128 defined by the second antenna element 124. For instance, a size of the one or more slots 126 defined by the first antenna element 122 can be different than a size of the one or more slots 128 defined by the second antenna element 124. Alternatively or additionally, a shape of the one or more slots 126 defined by the first antenna element 122 can be different than a shape of the one or more slots 128 defined by the second antenna element 124. In this manner, a radiation pattern associated with the first antenna element 122 can be different than a radiation pattern associated with the second antenna element 124.

In some implementations, one or more antenna elements of the plurality of antenna elements 120 can be a patch antenna. For instance, the one or more patch antennas can be disposed on the dome-shaped substrate 110 (FIG. 1). In some implementations, the one or more patch antennas can be disposed on the inner surface 114 (FIG. 1) of the dome-shaped substrate 100. Alternatively, the one or more patch antenna can be disposed on the outer surface 116 (FIG. 1) of the dome-shaped substrate 110. In some implementations, the patch array antenna can include a first patch antenna and a second patch antenna. The first patch antenna and the second patch antenna can have a first radiation pattern and a second radiation pattern, respectively. In some implementations, the first radiation pattern can be different than the second radiation pattern.

In some implementations, the plurality of antenna elements 120 (FIG. 1) can each have any suitable shape. For instance, one or more antenna elements of the plurality of antenna elements 120 can have a tetragonal shape, an oval shape, a spiral shape, or a polygonal shape. In some implementations, a shape of an antenna element of the plurality of antenna elements 120 (FIG. 1) can depend on a location of the antenna element on the dome-shaped substrate 110 (FIG. 1).

While the present subject matter has been described in detail with respect to specific example embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A phased array antenna defining a circumferential direction and a radial direction, the phased array antenna comprising:

a dome-shaped substrate having an inner surface and an outer surface; and a plurality of antenna elements disposed on the inner surface of the dome-shaped substrate such that the plurality of antenna elements are spaced apart from one another along the circumferential direction.

2. The phased array antenna of claim 1, wherein:

radio frequency (RF) signals emitted via the plurality of antenna elements propagate through the dome-shaped substrate; and RF signals received via the plurality of antenna elements propagate through the dome-shaped substrate.

3. The phased array antenna of claim 1, wherein the plurality of antenna elements disposed on the inner surface are positioned within a cavity defined by the dome-shaped substrate.

4. The phased array antenna of claim 1, wherein each antenna element of the plurality of antenna elements defines one or more slots.

5. The phased array antenna of claim 4, wherein the one or more slots defined by a first antenna element of the plurality of antenna elements are different than the one or more slots defined by a second antenna element of the plurality of antenna elements.

6. The phased array antenna of claim 5, wherein a size of the one or more slots defined by the first antenna element is different than a size of the one or more slots defined by the second antenna element.

7. The phased array antenna of claim 5, wherein a shape of the one or more slots defined by the first antenna element is different than a shape of the one or more slots defined by the second antenna element.

8. The phased array antenna of claim 5, wherein a radiation pattern associated with the first antenna element is different than a radiation pattern associated with the second antenna element.

9. The phased array antenna of claim 1, wherein:

a frequency of a radio frequency (RF) signal emitted via the plurality of antenna elements is between 100 megahertz (MHz) and 100 gigahertz (GHz); and a frequency of a RF signal received via the plurality of antenna elements is between 100 MHz and 100 gigahertz GHz.

10. The phased array antenna of claim 1, wherein the plurality of antenna elements are equally spaced from one another along the circumferential direction.

11. The phased array antenna of claim 1, wherein the plurality of antenna elements are the same size as one another.

12. The phased array antenna of claim 1, wherein the dome-shape substrate comprises a material having a dielectric constant ranging from 2 to 10.

13. The phased array antenna of claim 1, wherein the plurality of antenna elements comprise:

a first antenna element having a first gain in a first direction; and a second antenna element having a second gain in the first direction, the second gain being different than the first gain.

* * * * *